US007116158B2

(12) United States Patent
Teel et al.

(10) Patent No.: US 7,116,158 B2
(45) Date of Patent: Oct. 3, 2006

(54) BANDGAP REFERENCE CIRCUIT FOR ULTRA-LOW CURRENT APPLICATIONS

(75) Inventors: John C. Teel, Tucson, AZ (US); Tony R. Larson, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 131 days.

(21) Appl. No.: 10/959,485

(22) Filed: Oct. 5, 2004

(65) Prior Publication Data

US 2006/0071705 A1 Apr. 6, 2006

(51) Int. Cl.
*G05F 3/26* (2006.01)
*G05F 3/20* (2006.01)

(52) U.S. Cl. ..... 327/539; 323/313

(58) Field of Classification Search ..... 327/513, 327/539, 541, 543; 323/313–316
See application file for complete search history.

(56) References Cited

U.S. PATENT DOCUMENTS 5,187,395 A * 2/1993 Pirez ..... 327/362
5,451,860 A * 9/1995 Khayat ..... 323/314
6,091,286 A * 7/2000 Blauschild ..... 327/543
6,937,001 B1 * 8/2005 Ueda ..... 323/313
2004/0155700 A1 * 8/2004 Gower et al. ..... 327/543

* cited by examiner

*Primary Examiner*—Quan Tra
*Assistant Examiner*—Terry L. Englund
(74) *Attorney, Agent, or Firm*—J. Dennis Moore; W. James Brady; Frederick J. Telecky, Jr.

(57) ABSTRACT

A bandgap reference circuit as may be used in ultra-low current applications is provided. An exemplary bandgap circuit can be configured to generate a positive temperature coefficient without the need for a resistor to offset a negative temperature coefficient. In accordance with an exemplary embodiment of the present invention, a bandgap circuit comprises a negative temperature coefficient generated from a junction device and a positive temperature coefficient generated from an FET-based device. An exemplary junction device can comprise a bipolar, junction diode or any other device for generating a negative temperature coefficient, while an exemplary FET-based device comprises a gate-drain connected device configured to provide a gate-source voltage having a positive temperature coefficient coupled in series with the bipolar device. In accordance with another exemplary embodiment, the bandgap circuit can be configured with a threshold voltage elimination device comprising a second FET-based device configured to subtract out a threshold voltage component of the first FET-based device.

15 Claims, 2 Drawing Sheets

BANDGAP REFERENCE CIRCUIT FOR ULTRA-LOW CURRENT APPLICATIONS

FIELD OF INVENTION

The present invention relates to a bandgap reference for use in integrated circuits. More particularly, the present invention relates to a bandgap reference circuit as may be used in ultra-low current applications.

BACKGROUND OF THE INVENTION

The demand for less expensive, and yet more reliable integrated circuit components for use in mobile communication, imaging and high-quality video applications continues to increase rapidly. As a result, integrated circuit manufacturers are requiring greater accuracy in voltage references for such components and devices to meet the design requirements of such myriad emerging applications.

Voltage references are generally required to provide a substantially constant output voltage despite gradual or momentary changes in input voltage, output current or temperature. In particular, many designers have utilized bandgap reference circuits due to their ability to provide a stable voltage supply that is insensitive to temperature variations over a wide temperature range. These bandgap references rely on certain temperature-dependant characteristics of the base-emitter voltage, $V_{BE}$, of a transistor. Typically, these bandgap reference circuits operate on the principle of compensating the negative temperature coefficient of a base-emitter voltage, $V_{be}$, of a bipolar transistor with the positive temperature coefficient of the thermal voltage, i.e., with $V_{Thermal}$=kT/q, where k is Boltzmann's constant, T is the absolute temperature in degrees Kelvin, and q is the electronic charge. In general, the negative temperature coefficient of the base-emitter voltage $V_{BE}$ is summed with the positive temperature coefficient of the thermal voltage $V_{Thermal}$, which is appropriately scaled such that the resultant summation provides a zero temperature coefficient.

Conventional bandgap technologies generally comprise circuits designed to generate a positive temperature coefficient through a proportional-to-absolute-current $I_{PTAT}$ flowing through a resistor. For example, with reference to FIG. 1, a bandgap circuit 100 configured to provide a bandgap voltage $V_{BG}$ of approximately 1.2 volts comprises a positive temperature coefficient generated by a proportional-to-absolute-current $I_{PTAT}$ flowing through a resistor R, and a negative temperature coefficient of the base-emitter voltage $V_{BE}$ generated from a bipolar transistor $Q_1$. Proportional-to-absolute-current $I_{PTAT}$ is also typically generated by another bipolar and resistor circuit.

As the available quiescent current is reduced in bandgap circuit 100, the size of resistor R, as well as the size resistor used to generate proportional-to-absolute-current $I_{PTAT}$, must be suitably increased to obtain the necessary positive temperature coefficient to counterbalance the negative temperature coefficient. For example, to maintain a positive temperature coefficient voltage (IR) drop of approximately 0.6 volts, if a bias current is reduced to 50 nA, then at least a 12 Mohm value resistor R is required to maintain the necessary IR drop, as well as a smaller resistor, e.g., approximately 360 Kohm to 1 Mohm depending on emitter ratio, used to generate proportional-to-absolute-current $I_{PTAT}$. Integrated resistors of this size are not practical due to space limitations.

SUMMARY OF THE INVENTION

In accordance with various aspects of the present invention, a bandgap reference circuit as may be used in ultra-low current applications is provided. In accordance with one aspect of the present invention, an exemplary bandgap circuit can be configured to generate a positive temperature coefficient without the need for a resistor to offset a negative temperature coefficient, such as that generated by the base-emitter voltage from a bipolar transistor of the bandgap circuit. For example, an exemplary bandgap circuit is configured to generate the positive temperature coefficient from the electron mobility characteristic extracted from a transistor device.

In accordance with an exemplary embodiment of the present invention, a bandgap circuit comprises a negative temperature coefficient generated from a junction device and a positive temperature coefficient generated from an FET-based device. An exemplary junction device can comprise a bipolar-based device, a junction diode or any other device or component configured for generating a negative temperature coefficient. FET-based device comprises a gate-drain connected device configured to provide a positive temperature coefficient coupled in series with the junction device. In accordance with another exemplary embodiment, the bandgap circuit can be configured with a threshold voltage elimination device comprising a second FET-based device configured to subtract out a threshold voltage component of the first FET-based device.

In accordance with another exemplary embodiment of the present invention, an exemplary bandgap circuit can be configured to reduce a minimum supply voltage requirement. For example, an input supply voltage of less than two volts can be utilized for operation of a bandgap circuit for low-current applications. In accordance with an exemplary embodiment, an exemplary bandgap circuit can comprise a third current source to provide an additional bias current to facilitate the sinking of current.

In accordance with another exemplary embodiment of the present invention, an exemplary bandgap circuit can also be configured for curvature-correction to address the $V_{BE}$ characteristics of first order bandgap circuits. For example, an exemplary bandgap circuit can comprise a positive temperature coefficient generated by both a FET device and a resistor device. As a result, a more stable temperature-dependent voltage reference over a wider temperature range can be realized.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION

The present invention may be described herein in terms of various functional components and various processing steps. It should be appreciated that such functional components may be realized by any number of hardware or structural components configured to perform the specified functions. For example, the present invention may employ various integrated components, e.g., buffers, supply rail references, current mirrors, and the like, comprised of various electrical devices, e.g., resistors, transistors, capacitors, diodes and the like whose values may be suitably configured for various intended purposes. In addition, the present invention may be practiced in any integrated circuit application where stable voltage references are desired. Further, it should be noted that while various components may be suitably coupled or connected to other components within exemplary circuits, such connections and couplings can be realized by direct connection between components, or by connection through other components and devices located therebetween.

In accordance with various aspects of the present invention, a bandgap circuit as may be used in ultra-low current applications is provided. In accordance with one aspect of the present invention, an exemplary bandgap circuit can be configured to generate a positive temperature coefficient without the need for a resistor to offset the negative temperature coefficient, such as that generated by the base-emitter voltage from a bipolar transistor of the bandgap circuit.

Figure 3:
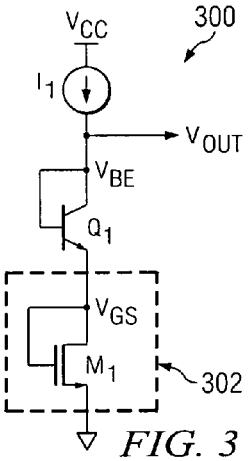
FIG. 3 illustrates a schematic diagram of an exemplary bandgap reference circuit in accordance with the present invention.

For example, in accordance with an exemplary embodiment of the present invention, with reference to FIG. 3, a PTAT-generator circuit 300, such as may be used within a bandgap circuit, includes a current source $I_1$, a negative temperature coefficient generated from a junction device $Q_1$, e.g., from the base-emitter voltage $V_{BE}$ of a bipolar device $Q_1$, and a positive temperature coefficient generating device 302. Device $Q_1$ comprises an NPN-based bipolar transistor device having a base-collector junction configured to receive current flowing from current source $I_1$ and configured to provide an output voltage $V_{OUT}$. While bipolar device $Q_1$ is utilized in accordance with one exemplary embodiment to generate a negative temperature coefficient, an exemplary junction device can comprise any circuit device or configuration of devices and components that may generate a negative temperature coefficient, such as, for example, a junction diode. Positive temperature coefficient generating device 302 can comprise any device configured for generating a positive temperature coefficient. For example, device 302 can provide a positive temperature coefficient generated from a FET-based device, e.g., a MOSFET device $M_1$.

Device $M_1$ comprises a gate-drain connected device configured to provide a gate-source voltage $V_{GS}$ having a positive temperature coefficient. Device $M_1$ is coupled in series with bipolar device $Q_1$ such that the sum of the devices provides an output voltage $V_{OUT}$ with approximately zero temperature coefficient, i.e., $V_{GS}+V_{BE}=V_{POUT}$. In the exemplary embodiment, device $M_1$ comprises a gate-drain connection coupled in series to the emitter of device $Q_1$.

Due to the electron mobility characteristics extracted, FET-based device $M_1$ can generate the positive temperature coefficient without the use of a proportional-to-absolute-current $I_{PTAT}$. Moreover, no additional resistor is necessary to generate the positive temperature coefficient within PTAT circuit 300, such any positive temperature coefficient required to be generated through current source $I_1$. Accordingly, current source $I_1$ can comprise any conventional current source configuration so long as the temperature coefficient of current source $I_1$ is not so negative as to eliminate the impact of the positive temperature coefficient from FET-based device $M_1$. For example, current source $I_1$ can comprise any constant current source that does not vary with temperature. To the extent that current source $I_1$ does include some positive temperature coefficient characteristics, then less dependence exists for device $M_1$ to provide the remaining positive temperature coefficient to cancel out the negative temperature coefficient of bipolar device $Q_1$. Thus, the device size/channel length of device $M_1$ can be suitably configured to provide a desired amount of positive temperature coefficient, e.g., device $M_1$ can be configured with a smaller channel length for less positive temperature coefficient effect. Accordingly, scaling both the amount of temperature coefficient of current source $I_1$ and the size of device $M_1$ can suitably control the amount of positive temperature coefficient.

With reference again to FIG. 3, positive temperature coefficient generating FET-based device $M_1$ comprises various parameters and characteristics that can affect the positive temperature coefficient for bandgap circuit 300. For example, the gate-source voltage $V_{GS}$ for device $M_1$ comprises a saturation voltage component $V_{DSAT}$ and a threshold voltage component $V_{TH}$, i.e., $V_{GS}=V_{DSAT}+V_{TH}$. Saturation voltage component $V_{DSAT}$ is configured to provide the positive temperature coefficient for cancellation of the negative temperature coefficient of base-emitter voltage $V_{BE}$. However, threshold voltage component $V_{TH}$ is an additional component that can affect operation of bandgap circuit 300. For example, threshold voltage component $V_{TH}$ has a negative temperature coefficient and is very sensitive to process changes and variations. As a result, threshold voltage component $V_{TH}$ should be cancelled out in order to obtain a low temperature coefficient, process-insensitive bandgap voltage.

Figure 4:
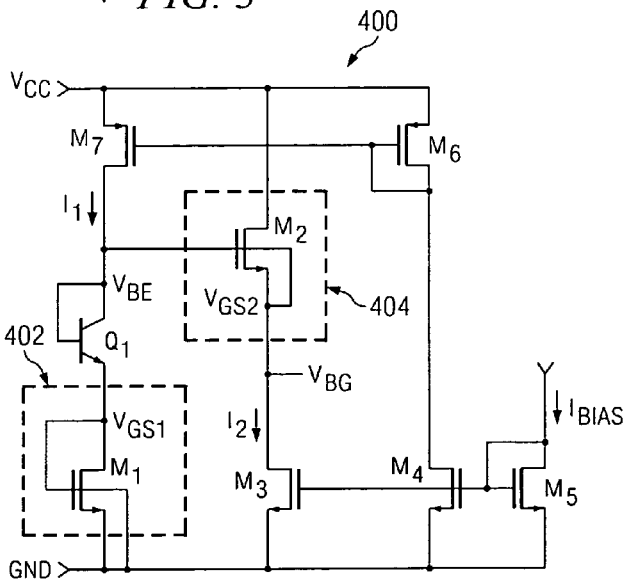
FIG. 4 illustrates a schematic diagram of an exemplary bandgap reference circuit in accordance with another exemplary embodiment of the present invention.

In accordance with another exemplary embodiment, an exemplary bandgap circuit can be configured with a threshold voltage elimination device configured to subtract out threshold voltage component $V_{TH}$ of first FET-based device $M_1$. An exemplary threshold elimination device can comprise various configurations for canceling out threshold voltage component $V_{TH}$. In accordance with an exemplary embodiment, an exemplary threshold elimination device comprises a second FET-based device. For example, with reference to FIG. 4, an exemplary bandgap circuit 400 comprises a negative temperature coefficient generated from a bipolar device $Q_1$ and a positive temperature coefficient generated from a device 402 and a threshold elimination device 404, e.g., generated from a first FET-based device $M_1$ and a second FET-based device $M_2$. Bandgap circuit 400 also comprises a bias circuit for generating a pair of current sources, $I_1$ and $I_2$.

Device $Q_1$ comprises an NPN-based bipolar transistor device having a base-collector junction configured to receive current flowing from current source $I_1$ and configured to provide an output for bandgap voltage $V_{BG}$. Device $M_1$ comprises a gate-drain connected transistor configured to provide a gate-source voltage $V_{GS1}$, and is coupled in series to the emitter of device $Q_1$. Second device $M_2$ comprises a gate-source connected transistor configured in a source-follower configuration to provide a second gate-source voltage $V_{GS2}$ comprising a second saturation voltage component $V_{DSAT2}$ and a second threshold voltage component $V_{TH2}$. The gate-source connection of second device $M_2$ is coupled to the collector of device $Q_1$, and also provides the output for bandgap voltage $V_{BG}$. As a result, the configuration of devices $M_1$, $M_2$ and $Q_1$ provides a bandgap voltage $V_{BG}$ with approximately zero temperature coefficient, with the subtraction out of the threshold voltage components. In other words:

$$V_{BG}=V_{BE}+V_{GS1}-V_{GS2}=V_{BE}+V_{DSAT1}+V_{TH1}-V_{DSAT2}-V_{TH2}$$

wherein threshold components $V_{TH1}$ and $V_{TH2}$ are approximately equal in magnitude and thus suitably subtract out from bandgap reference voltage $V_{BG}$, such that:

$$V_{BG}=V_{BE}+V_{DSAT1}-V_{DSAT2}$$

or stated another way:

$$V_{BG} = V_{BE} + \overline{\overline{\sqrt{\frac{I_1}{\mu * C_{ox} * (W/L)_1}}}}^{V_{DSAT1}} - \overline{\overline{\sqrt{\frac{I_2}{\mu * C_{ox} * (W/L)_2}}}}^{V_{DSAT2}}$$

The effects on the positive temperature coefficient for saturation voltages $V_{DSAT1}$ and $V_{DSAT2}$ can be suitably controlled based on device sizes, i.e., based on the device sizes or W/L ratios of devices $M_1$ and $M_2$. For example, by controlling the channel lengths of devices $M_1$ and $M_2$, the contributions on the positive temperature coefficient of each device can be suitably controlled. As an illustrative example, if the device size for device $M_1$ is approximately 5/200, and the device size for device $M_2$ is approximately 10/1, device $M_2$ will have a significantly smaller saturation component $V_{DSAT2}$ as compared to saturation voltage $V_{DSAT1}$ of device $M_1$ such that only device $M_1$ in effect contributes to the positive temperature coefficient realized. In other words, by making $W/L_2 >> W/L_1$ for devices $M_1$ and $M_2$, saturation voltage $V_{DSAT2}$ is greatly minimized, and thus the affect on the positive temperature coefficient is substantially eliminated $$V_{BG} \approx V_{BE} + \sqrt{\frac{I_1}{\mu * C_{ox} * (W/L)_1}}$$

In that the electron mobility μ has a temperature coefficient of $T^{-3/2}$ and that current source $I_1$ has a temperature coefficient of $T^{\alpha}$, wherein α depends on the type of current, i.e., α=1 for a proportional-to-temperature current $I_{PTAT}$, the bandgap equation becomes:

$$V_{BG} = V_{BE} + T^{\frac{2\alpha+3}{4}} \sqrt{\frac{I_1'}{\mu' * C_{ox} * (W/L)_1}}$$

Accordingly, bandgap voltage $V_{BG}$ will approximately equal the summation of base-emitter voltage $V_{BE}$ of bipolar device $Q_1$ plus saturation voltage $V_{DSAT1}$ of device $M_1$, such that the negative and positive temperature coefficients can be suitably balanced out, i.e., zeroed out, to provide an approximately zero temperature coefficient for bandgap voltage $V_{BG}$.

To prevent a negative temperature coefficient from current source $I_1$ from overwhelming the positive temperature coefficient provided by the electron mobility μ, then α should be greater than −3/2. In the event that a proportional-to-temperature current $I_{PTAT}$ is used, α=1, then the effects of the negative temperature coefficient from base-emitter voltage $V_{BE}$ can be reduced. Further, if α is less than 1, then the negative temperature coefficient from base-emitter voltage $V_{BE}$ is larger, and therefore more positive temperature coefficient is required from saturation voltage $V_{DSAT1}$.

The exemplary bias circuit for generating a pair of current sources, $I_1$ and $I_2$, can be configured in various manners. In the exemplary embodiment illustrated in FIG. 4, a single bias current $I_{BIAS}$ can be provided to a current mirror circuit comprising transistor devices $M_3$ and $M_5$ to generate current source $I_2$, and a current mirror circuit comprising transistors $M_7$ and $M_6$ and transistors M4 and $M_5$ to generate current source $I_1$. However, current sources $I_1$ and $I_2$ can also be suitably generated by different current mirror configurations and/or with additional bias current references, or any other circuit arrangement for generating multiple current sources.

Current source $I_1$ can be configured as a constant current that does not vary with temperature, or can be configured with a positive temperature coefficient characteristic, thus offsetting the amount of positive temperature coefficient necessary from device $M_1$. However, since the effect of temperature coefficient of device $M_2$ is minimized, the temperature coefficient of current source $I_2$ is inconsequential. As a result, current source $I_2$ can comprise a positive or negative coefficient without affecting the overall temperature coefficient of bandgap voltage $V_{BG}$. In addition, the source-follower configuration of device $M_2$ can source significant current, depending of the size of device $M_2$. In that current source $I_2$ cannot be pulled down when driving device $M_2$, bandgap circuit 400 can facilitate the sourcing of current to a load device.

During operation, bandgap circuit 400 requires a minimum level of input supply voltage to provide an output for bandgap voltage $V_{BG}$. For example, to bias on devices $M_1$, $Q_1$ and $M_7$, approximately two volts of input supply voltage may be required, e.g., approximately 1.2 volts for gate-source voltage $V_{GS1}$, approximately 0.6 volts for base-emitter voltage $V_{BE}$, and 0.2 volts for saturation voltage $V_{DSAT}$ for device $M_7$. In some applications, a minimum level of input supply voltage less than two volts may be desired.

Figure 5:
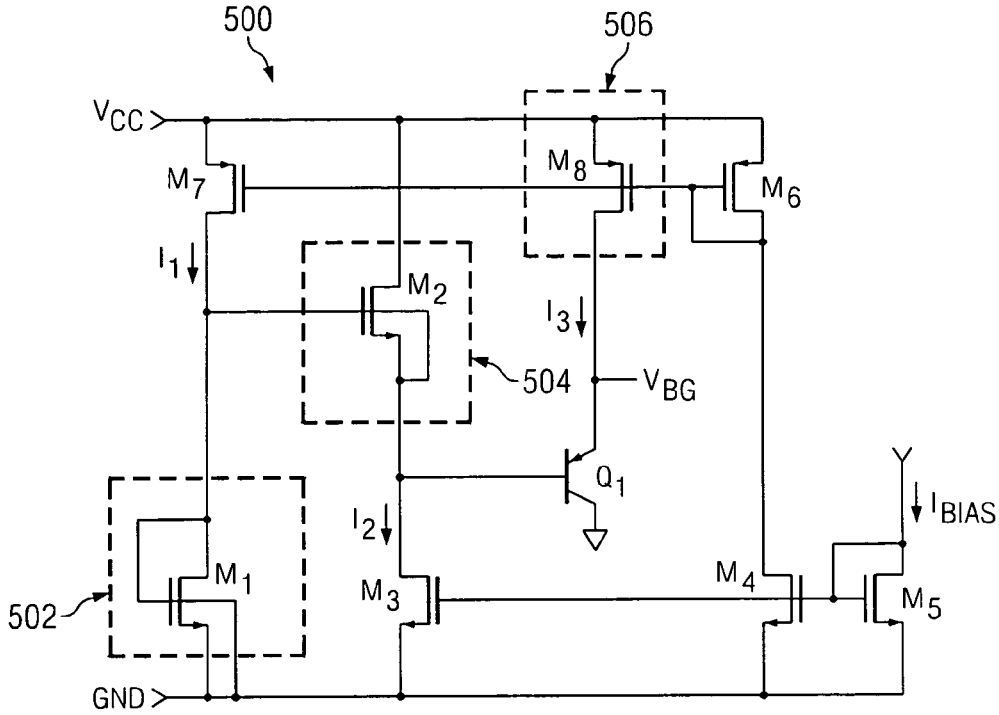
FIG. 5 illustrates a schematic diagram of an exemplary bandgap reference circuit in accordance with another exemplary embodiment of the present invention.

In accordance with another exemplary embodiment of the present invention, an exemplary bandgap circuit can be configured to reduce a minimum supply voltage requirement. For example, an input supply voltage of less than approximately two volts can be utilized for operation of a bandgap circuit for low-current applications. With reference to FIG. 5, in accordance with an exemplary embodiment, an exemplary bandgap reference circuit 500 comprises a positive temperature coefficient generated from a first FET-based device 502 comprising gate-drain connected transistor $M_1$ and a second FET-based device 504 comprising a gate-source connected transistor $M_2$, and a negative temperature coefficient generated from a bipolar device $Q_1$.

In this exemplary embodiment, device $Q_1$, comprises a PNP-based emitter-follower configuration comprising a bipolar transistor device having a base terminal coupled to the gate-source terminal of transistor $M_2$ and an emitter terminal configured to provide an output for bandgap voltage $V_{BG}$. In addition, due to the PNP-based configuration, device $Q_1$ can be configured to facilitate the sinking of current from a load device.

Device $M_1$ is configured to receive current flowing from current source $I_1$ and configured to provide a gate-source voltage $V_{GS1}$ comprising a first saturation voltage component $V_{DSAT1}$ and a first threshold voltage component $V_{TH1}$, while second device $M_2$ is configured to provide a second gate-source voltage $V_{GS2}$ comprising a second saturation voltage component $V_{DSAT2}$ and a second threshold voltage component $V_{TH2}$ that can suitably subtract out first threshold voltage component $V_{TH1}$. The gate-source connection of second device $M_2$ is further configured to receive a second bias current source $I_2$.

In accordance with the exemplary embodiment, an exemplary bandgap circuit 500 also comprises a bias circuit for generating a pair of current sources, $I_1$ and $I_2$, as well as a third current source $I_3$ to provide an additional bias current to bias on device $Q_1$. For example, a single bias current $I_{BIAS}$ can be provided to a current mirror circuit comprising transistor devices $M_3$ and $M_5$ to generate current source $I_2$, a current mirror circuit comprising transistors $M_7$ and $M_6$ and transistors $M_4$ and $M_5$ to generate current source $I_1$, and a current mirror circuit comprising transistors $M_8$ and $M_6$ and transistors $M_4$ and $M_5$ to generate additional current source $I_3$. However, current sources $I_1$, $I_2$ and $I_3$ can also be suitably generated by different current mirror configurations with additional bias current references, or any other circuit arrangement for generating multiple current sources.

However, due to the configuration of devices $M_1$, $M_7$ and $Q_1$ and $M_7$, bandgap circuit 400 requires a reduced minimum level of input supply voltage to provide an output for bandgap voltage $V_{BG}$. For example, only devices $M_1$ and $M_7$ need to be biased on, resulting in approximately 1.4 volts of input supply voltage being required, e.g., approximately 1.2 volts for gate-source voltage $V_{GS1}$ and 0.2 volts for saturation voltage $V_{DSAT}$ for device $M_7$, without the approximately 0.6 volts needed for biasing on base-emitter voltage $V_{BE}$.

Accordingly, for applications that desire lower minimum levels of input supply voltage, the configuration of bandgap reference circuit 500 may be more desirable, and for applications that the amount of bias current is an important design criteria, the configuration of bandgap reference circuit 400 with less than three bias currents may be more desirable.

Figure 1:
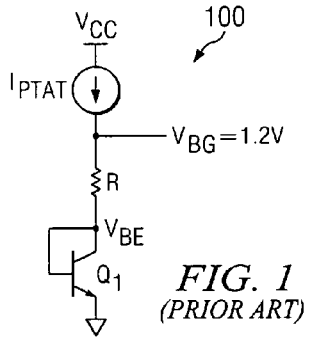
FIG. 1 (PRIOR ART)
FIG. 1 illustrates a schematic diagram of a prior art bandgap reference circuit.
Figure 2:
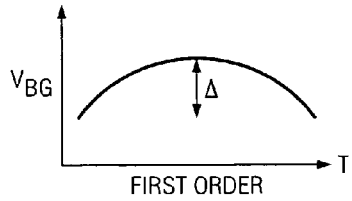
FIG. 2 (PRIOR ART)
FIG. 2 illustrates a curve representing a first-order characteristic of a prior art bandgap reference circuit.
Figure 7A:
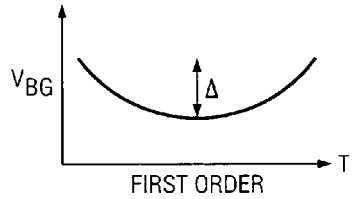
FIG. 7 illustrates exemplary curves representing a first-order and second-order characteristic of an exemplary bandgap reference circuit in accordance with the present invention.

Bandgap circuits 300, 400 and 500 are suitably configured for providing first-order temperature coefficient correction for a bandgap voltage $V_{BG}$. With momentary reference to FIG. 2, prior art bandgap circuits tend to provide a first order concave down characteristic for bandgap voltage $V_{BG}$ versus temperature T. However, with reference to FIG. 7A, bandgap circuits 300, 400 and 500 tend to provide a first-order concave up characteristic. In accordance with another exemplary embodiment of the present invention, an exemplary bandgap circuit can also be configured in a manner to provide for second-order curvature-correction to address the $V_{BE}$ characteristics of first-order bandgap circuits. As a result, a more stable temperature-dependent voltage reference over a wider temperature range can be realized.

Figure 6:
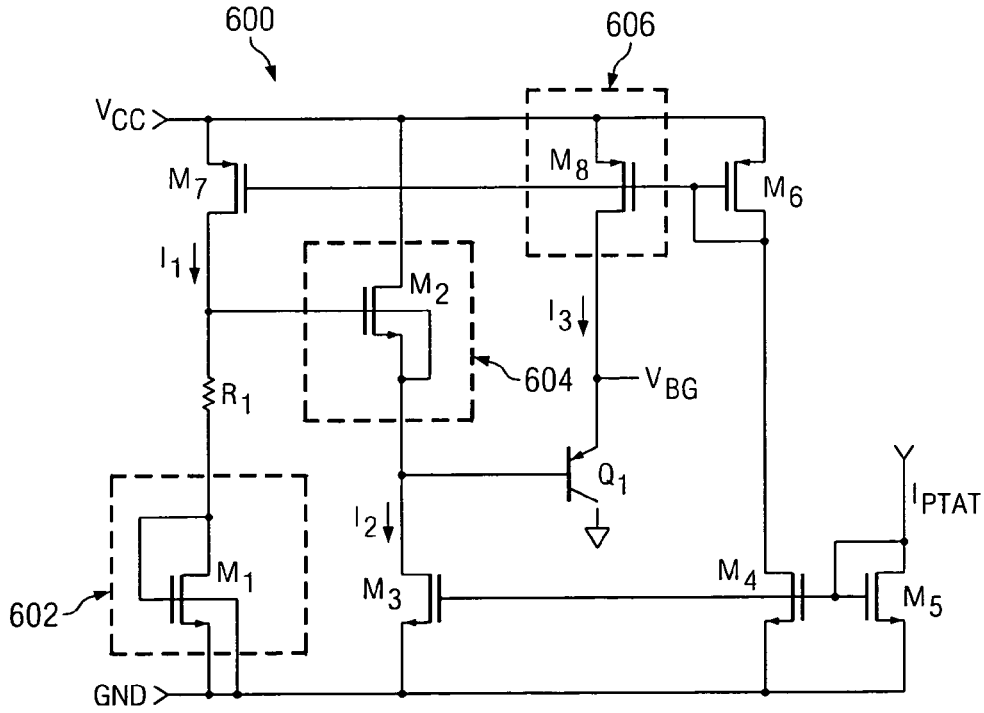
FIG. 6 illustrates a schematic diagram of an exemplary bandgap reference circuit in accordance with another exemplary embodiment of the present invention.

For example, an exemplary bandgap circuit can also be configured in a manner to provide for curvature-correction to address the $V_{BE}$ characteristics of first-order bandgap circuits by combining aspects of bandgap circuits 300, 400 and 500 producing concave up characteristics with resistor-based bandgap circuits with concave down characteristics for a second-order correction. With reference to FIG. 6, in accordance with an exemplary embodiment, an exemplary bandgap circuit 600 can comprise a positive temperature coefficient generated by an FET device 602, i.e., device $M_1$, (or with FET devices 602 and 604) and a resistor device $R_1$. Resistor $R_1$ can comprise any resistor configuration for providing a proportional to temperature current component. In addition, while exemplary bandgap circuit 600 is configured for minimization of a supply voltage requirement, i.e., only devices $M_1$ and $M_7$ need to be biased on, exemplary bandgap circuit 600 can also be configured with bipolar device $Q_1$ configured in series with resistor $R_1$ and device $M_1$, e.g., resistor $R_1$ configured in between bipolar device $Q_1$ and device $M_1$ of bandgap reference circuits 300 and 400 illustrated in FIGS. 3 and 4, respectively, or any other series-like configuration with bipolar device $Q_1$ and device $M_1$.

In accordance with this exemplary embodiment, a positive temperature coefficient can be suitably generated partially by FET device 602 (with or without FET device 604, i.e., device $M_2$, as illustrated in bandgap circuits 400 and 500) and partially by resistor device $R_1$. The amount of positive temperature coefficient generated by one or more devices can be suitably scaled depending on any number of design considerations. To facilitate resistor $R_1$ in providing a positive temperature coefficient, bandgap circuit 600 can be configured with a proportional to temperature current $I_{PTAT}$ for biasing, with the amount of biasing current being able to control the amount of positive temperature coefficient. Moreover, the amount of positive temperature coefficient can also be suitably adjusted or configured through control of transistor device $M_7$. Accordingly, any combination of contributions of positive temperature coefficients from devices $M_1$, $M_2$, $M_7$, and/or resistor $R_1$ to yield a desired positive temperature coefficient can be utilized.

Figure 7B:
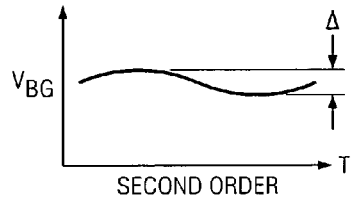

As a result of combining aspects of bandgap circuits 300, 400 and/or 500 that produce concave up characteristics with a resistor-based bandgap circuit that produces concave down characteristics, a second-order curvature-correction to address the $V_{BE}$ characteristics of first-order bandgap circuits can be realized. For example, with reference to FIG. 7B, an exemplary second-order characteristic for a bandgap voltage $V_{BG}$ versus temperature T illustrates a more stable temperature-dependent voltage reference over a wider temperature range.

Figure 8:
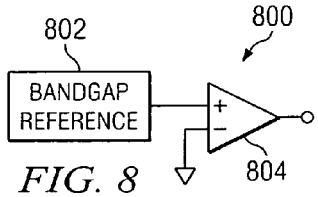
FIG. 8 illustrates an exemplary bandgap reference circuit configured within an amplifier circuit in accordance with the present invention.

Exemplary bandgap reference circuits 300, 400 and/or 500 can be configured within various integrated circuit applications for providing a stable reference voltage. For example, with reference to FIG. 8, an integrated circuit 800 can comprise an exemplary bandgap reference circuit 802 configured to provide a voltage reference to an amplifier circuit 804. Amplifier circuit 804 can comprise any amplifier configuration utilized with bandgap reference voltages. Moreover, in addition to amplifier circuit 804, bandgap reference circuit 802 can be configured with any other device or circuit configured for use with bandgap reference voltages.

The present invention has been described above with reference to an exemplary embodiment. However, those skilled in the art will recognize that changes and modifications may be made to the exemplary embodiment without departing from the scope of the present invention. For example, the various components may be implemented in alternate ways, such as, for example, by replacing one or more of the bipolar transistors with junction diodes, or deriving the negative and/or positive temperature coefficients from the various resistive materials found in the integrated circuit technology being utilized to implement the bandgap reference. These alternatives can be suitably selected depending upon the particular application or in consideration of any number of factors associated with the operation of the system. These and other changes or modifications are intended to be included within the scope of the present invention, as expressed in the following claims.

The invention claimed is:

1. A bandgap reference circuit for use in a low-current application, said bandgap reference circuit comprising: a junction device configured for generating a negative temperature coefficient; and an FET-based transistor device configured for generating a positive temperature coefficient, said positive temperature coefficient being configured to balance out said negative temperature coefficient generated from said junction device, wherein said bandgap reference circuit further comprises a threshold voltage elimination device configured for cancellation of a threshold voltage component within said FET-based transistor device.

2. A bandgap reference circuit according to claim 1, wherein said FET-based transistor device is configured for receiving a first bias current, and said threshold voltage elimination device comprises a second FET-based transistor device configured for receiving a second bias current, said second FET-based transistor device configured with said first FET-based transistor device to provide said positive temperature coefficient.

3. A bandgap reference circuit according to claim 2, wherein said second FET-based transistor device comprises a gate-source connected device coupled to a gate-drain connection of said first FET-based transistor device.

4. A bandgap reference circuit according to claim 1, wherein said junction device comprises a bipolar device, and said threshold voltage component comprises a second FET-based transistor device having a gate-source connection coupled to a base-collector connection of said bipolar device.

5. A bandgap reference circuit for use in a low-current application, said bandgap reference circuit comprising: a junction device configured for generating a negative temperature coefficient; and an FET-based transistor device configured for generating a positive temperature coefficient, said positive temperature coefficient being configured to balance out said negative temperature coefficient generated from said junction device, wherein said bandgap reference circuit comprises a threshold voltage elimination device configured for cancellation of a threshold voltage component within said FET-based transistor device, wherein said junction device comprises a bipolar device, wherein said FET-based transistor device is configured for receiving a first bias current, and said threshold voltage component comprises a second FET-based transistor device configured for receiving a second bias current and having a gate-source connection coupled directly to a gate-drain connection of said first FET-based transistor device, and said bipolar device is configured for receiving a third bias current and having a base terminal coupled to said gate-source connection of said second FET-based transistor device to facilitate a minimization of a supply voltage requirement.

6. An amplifier circuit configured with a bandgap reference circuit for generating a bandgap voltage, said bandgap reference circuit comprising: a junction device configured for generating a negative temperature coefficient; and an FET-based transistor device configured for generating a positive temperature coefficient, said positive temperature coefficient being configured to sum with said negative temperature coefficient to provide an aproximately zero temperature coefficient in said bandgap voltage, wherein said bandgap reference circuit further comprises a threshold voltage elimination device configured for cancellation of a threshold voltage component within said FET-based transistor device.

7. An amplifier circuit according to claim 6, wherein said FET-based transistor device is configured for receiving a first bias current, and wherein said threshold voltage component comprises a second FET-based transistor device configured for receiving a second bias current, and further configured with said first FET-based transistor device to provide said positive temperature coefficient.

8. An amplifier circuit according to claim 7, wherein said second FET-based transistor device comprises a gate-source connected device coupled to a gate-drain connection of said first FET-based transistor device.

9. An amplifier circuit according to claim 6, wherein said junction device comprises a bipolar device, and said threshold voltage component comprises a second FET-based transistor device having a gate-source connection coupled to a base-collector connection of said bipolar device.

10. An amplifier circuit according to claim 6, wherein said FET-based transistor device is configured for receiving a first bias current, wherein said junction device comprises a bipolar device, and said threshold voltage component comprises a second FET-based transistor device configured for receiving a second bias current and having a gate-source connection coupled directly to a gate-drain connection of said first FET-based transistor device, and said bipolar device configured for receiving a third bias current and having a base terminal coupled to said gate-source connection of said second FET-based transistor device to facilitate a minimization of a supply voltage requirement.

11. An amplifier circuit according to claim 7, wherein said bandgap reference circuit further comprises a current mirror circuit configured to receive a single bias current reference and to provide said first bias current for said FET-based transistor device and said second bias current for said second FET-based transistor device.

12. An amplifier circuit according to claim 11, wherein said current mirror circuit further provides a third bias current for said junction device.

13. A bandgap reference circuit for use in an integrated circuit application, said bandgap reference circuit comprising: a negative temperature coefficient generating device; and a positive temperature coefficient generating device, said positive temperature coefficient generating device configured for zeroing out a temperature coefficient in said bandgap reference circuit wherein said positive temperature coefficient generating device comprises a gate-drain connected transistor device, wherein said bandgap reference circuit further comprises a gate-source connected transistor device configured for subtracting out a threshold voltage component within said gate-drain connected transistor device.

14. A bandgap reference circuit according to claim 13, wherein said negative temperature coefficient generating device comprises a bipolar device, said gate-source connected transistor device having a gate-source connection coupled to a gate-drain connection of said gate-drain connected transistor device and further coupled to a base connection of said bipolar device.

15. An integrated circuit comprising a bandgap reference circuit for providing a reference voltage, said bandgap reference circuit comprising: a junction transistor device configured for generating a negative temperature coefficient; and an FET-based transistor device configured for generating a positive temperature coefficient, said positive temperature coefficient being configured to balance out said negative temperature coefficient, wherein said FET-based transistor device is configured for receiving a first bias current, and said bandgap reference circuit further comprises a threshold voltage elimination device comprising a second FET-based transistor device configured for receiving a second bias current, said second FET-based transistor device configured with said first FET-based transistor device to provide said positive temperature coefficient.

* * * * *